US012207785B2

(12) United States Patent
Cho et al.

(10) Patent No.: US 12,207,785 B2
(45) Date of Patent: Jan. 28, 2025

(54) CLEANER

(71) Applicant: SAMSUNG ELECTRONICS CO., LTD., Suwon-si (KR)

(72) Inventors: Youngjun Cho, Suwon-si (KR); Hyeonwoo Tak, Suwon-si (KR); Ohkyu Kwon, Suwon-si (KR); Dongjin Cho, Suwon-si (KR); Seongtae Chu, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 196 days.

(21) Appl. No.: 17/592,834

(22) Filed: Feb. 4, 2022

(65) Prior Publication Data

US 2022/0322901 A1 Oct. 13, 2022

Related U.S. Application Data

(63) Continuation of application No. PCT/KR2022/000114, filed on Jan. 5, 2022.

(30) Foreign Application Priority Data

Apr. 9, 2021 (KR) ..... 10-2021-0046668

(51) Int. Cl.

| | |
|---|---|
| ***A47L 9/24*** | (2006.01) |
| ***A47L 5/28*** | (2006.01) |
| ***A47L 9/02*** | (2006.01) |

(52) U.S. Cl.

CPC ..... *A47L 9/242* (2013.01); *A47L 5/28* (2013.01); *A47L 9/02* (2013.01)

(58) Field of Classification Search

CPC . A47L 5/225; A47L 5/24; A47L 5/242; A47L 5/248; A47L 5/28; A47L 5/30;

(Continued)

(56) References Cited

U.S. PATENT DOCUMENTS

2004/0261219 A1* 12/2004 Park ..... A47L 9/325 15/410

2019/0167058 A1 6/2019 Cho et al.

(Continued)

FOREIGN PATENT DOCUMENTS

CN 101301183 A 11/2008

KR 20-2001-0001365 U 1/2001

(Continued)

OTHER PUBLICATIONS

International Search Report dated May 3, 2022 for International Application No. PCT/KR2022/000114.

(Continued)

*Primary Examiner* — Laura C Guidotti

*Assistant Examiner* — Sidney D Full

(74) *Attorney, Agent, or Firm* — STAAS & HALSEY LLP

(57) ABSTRACT

A cleaner includes a housing provided to receive a fan motor unit configured to generate a suction force and a dust collecting chamber provided to collect foreign substances, a suction head coupled to a lower portion of the housing to suck the foreign substances on a surface to be cleaned, a neck arranged between the suction head and the housing to connect the suction head to the housing, the neck rotatable with respect to the suction head and detachably coupled to the housing, a switch device arranged on one side of the neck to allow the neck and the housing to be coupled to each other or separated from each other, and a rotating body rotatably coupled to the neck and configured to lock or unlock the switch device according to a position of the neck with respect to the suction head.

20 Claims, 10 Drawing Sheets

(58) Field of Classification Search
CPC ..... A47L 11/4075; A47L 9/02; A47L 9/325; A47L 11/40; A47L 11/4052–4058; Y10T 292/1047; F16L 37/0847
USPC ..... 285/7, 307, 312, 317, 308; 15/410, 411
See application file for complete search history.

(56) References Cited

U.S. PATENT DOCUMENTS

| | | | | |
|---|---|---|---|---|
| 2020/0281429 | A1 | 9/2020 | Cho et al. | |
| 2021/0093135 | A1 | 4/2021 | Chu et al. | |
| 2022/0022711 | A1* | 1/2022 | Lee | A47L 9/242 |

FOREIGN PATENT DOCUMENTS

| | | | |
|---|---|---|---|
| KR | 10-0681495 | B1 | 2/2007 |
| KR | 10-1505932 | B1 | 3/2015 |
| KR | 10-2017-0127629 | A | 11/2017 |
| KR | 10-2019-0066239 | A | 6/2019 |

OTHER PUBLICATIONS

Extended European Search Report dated Apr. 19, 2024 for corresponding application No. 22784744.9.

* cited by examiner

CLEANER

CROSS-REFERENCE TO RELATED APPLICATION(S)

This application is a continuation application under 35 U.S.C. § 111(a), of international application No. PCT/KR2022/000114, filed on Jan. 5, 2022, which is based on and claims priority under 35 U.S.C. § 119 to Korean Patent Application No. 10-2021-0046668, filed on Apr. 9, 2021, in the Korean Intellectual Property Office, the disclosure of which is incorporated by reference herein in its entirety.

BACKGROUND

Field

The disclosure relates to a cleaner, and more particularly, to a cleaner including an improved structure to increase user convenience.

Description of Related Art

A cleaner is a device configured to clean a room by removing rubbish, and a vacuum cleaner is generally used at the home. The vacuum cleaner uses suction power of a fan motor unit to suction air, and then sorts rubbish in the sucked air with a device such as a filter, thereby keeping the room clean.

The vacuum cleaner includes a suction head provided to suction rubbish such as hair on a surface to be cleaned by the suction force of air, a housing connected to the suction head, a main body provided inside the housing, and a neck provided to connect the housing to the suction head.

In general, a user presses a switch provided on the neck to separate the housing and the suction head from each other, or rotate the suction head or the housing to separate the housing and the suction head from each other. Alternatively, a switch is provided on the suction head and a user steps the switch to separate the housing and the suction head from each other.

However, in order to separate the housing and the suction head from each other, the user had to bend down to use the switch, and when the switch is provided on an upper portion of the suction head, the upper portion of the head protrudes, which may cause inconvenient to clean a space under furniture. Accordingly, there has been a demand for a switch device configured to easily separate the suction head and the housing from each other without bending at the waist, and configured to clean a space under the furniture.

SUMMARY

In accordance with an aspect of the disclosure, a cleaner includes a housing to house a fan motor configured to generate a suction force, and a dust collecting chamber configured to collect foreign substances, a suction head having an air flow path, the suction head couplable to the housing and configured to guide the foreign substances along the air flow path, using the suction force generated by the fan motor, from a surface to be cleaned to the dust collecting chamber, a neck arranged between the suction head and the housing and configured to connect the suction head to the housing, the neck rotatable with respect to the suction head and couplable to and decouplable from the housing, a switch device disposed on one side of the neck to allow the neck and the housing to be couplable to and decouplable from each other, and a rotating body rotatably couplable to the neck and configured to lock the switch device while the neck is at a first position with respect to the suction head and unlock the switch device while the neck is at a second position with respect to the suction head.

The neck may include an outer case, an inner case disposed inside of the outer case and configured to receive the rotating body between the inner case and the outer case, a holder coupled to the rotating body and the inner case and configured to receive the rotating body, and a rotating shaft configured to rotatably couple the rotating body to the holder.

The rotating shaft may be coupled to an upper portion of the rotating body. A cross-section area of a lower portion of the rotating body may have a cross-sectional area greater than a cross-sectional area of the upper portion of the rotating body to allow the center of gravity to be positioned at the lower portion of the rotating body.

At a position in which the neck is inclined with respect to the suction head, a lower surface of the rotating body may be in contact with the switch device.

In response to rotation of the neck with respect to the suction head, the rotating body may be rotated by gravity.

The switch device may include a switch button arranged outside the neck, and a switch member coupled to the housing and the switch button so that the housing and the neck are coupled to each other.

The switch member may be provided in plural, and a plurality of switch members may include a first switch member coupled to the switch button and in contact with the lower surface of the rotating body at a position of the neck in which the switch button is locked, and a second switch member arranged above the first switch member so as to be coupled to the first switch member, and including a coupling protrusion protruding to an inside of the neck to be coupled to the housing.

The housing may include a fastening protrusion provided at a lower end of the housing to be fastened to the coupling protrusion of the second switch member. The neck may include an outer case and an inner case disposed inside of the outer case and configured to receive the plurality of switch members and the rotating body between the inner case and the outer case. The coupling protrusion may protrude to an inside of the inner case and be fastened to the fastening protrusion.

The switch device may be rotatably coupled to the inner case, and in response to the switch button being pressed at a position of the neck in which the switch button is unlocked, the first switch member and the second switch member may be rotated to allow the coupling protrusion and the fastening protrusion to separate from each other.

The position of the neck in which the switch button is unlocked may be a position in which the neck is perpendicular to the suction head.

The position of the neck in which the switch button is locked may be a position in which the neck is inclined with respect to the suction head, and in response to the switch button being pressed at the position in which the neck is inclined with respect to the suction head, the first switch member may press the lower surface of the rotating body.

The neck may further include an elastic member arranged between the outer case and the second switch member and provided to elastically press the second switch member to allow the switch device to return to its original position after the switch button is pressed at the position of the neck in which the switch button is unlocked.

The switch button may be coupled to the neck in a rear side of the neck. The first switch member may include a first coupling portion arranged in an upper portion of the first switch member to be coupled to the second switch member, and the second switch member may include a second coupling portion arranged in a lower portion of the second switch member to be coupled to the first coupling portion of the first switch member. The first coupling portion may be arranged in a front side than the second coupling portion.

The switch device may further include a shaft provided in a lower side of the first coupling portion to allow the first switch member and the second switch member to be rotatable.

The elastic member may be arranged above the shaft.

In accordance with another aspect of the disclosure, a cleaner includes a housing provided to house a fan motor configured to generate a suction force, and a dust collecting chamber configured to collect foreign substances, a suction head having an airflow path, the suction head couplable to the housing and configured to guide the foreign substances along the air flow path, using the suction force generated by the fan motor, from a surface to be cleaned to the dust collecting chamber, a neck having a through hole to allow the suction head and the housing to be connected to each other, the neck couplable to and decouplable from the housing at a lower end of the housing, and a switch device coupled to the housing and the neck. The switch device includes a switch button including an insertion protrusion protruding toward the neck so as to be coupled to a rear surface of the neck, and a switch member including a recess provided to receive the insertion protrusion and a coupling protrusion protruding into the neck through the through hole of the neck, the switch member configured to be rotatable according to a pressure of the switch button so as to allow the housing and the neck to be couplable to and decouplable from each other.

The neck may include an outer case, and an inner case disposed inside of the outer case and configured to receive the switch member between the inner case and the outer case. The housing may include a fastening protrusion provided at the lower end of the housing to fasten to the coupling protrusion. The switch member includes a first switch member coupled to the switch button, and a second switch member arranged above the first switch member so as to be coupled to the first switch member, and including a coupling protrusion protruding to an inside of the neck to be coupled to the housing. In response to the switch button being pressed, the first switch member and the second switch member may be rotated to allow the coupling protrusion and the fastening protrusion to separate from each other.

The cleaner may further include a rotating body rotatably coupled to the neck, and configured to lock the switch device at a position in which the neck is inclined with respect to the suction head, and to unlock the switch device at a position in which the neck is perpendicular to the suction head.

In response to the switch button being pressed at the position in which the neck is inclined with respect to the suction head, the first switch member may press the lower surface of the rotating body.

In accordance with another aspect of the disclosure, a cleaner includes a housing to house a dust collecting chamber configured to collect foreign substances and a head assembly coupled to the housing to and configured to suction the foreign substances on a surface to be cleaned. The head assembly includes a suction head configured to guide the suctioned foreign substances on the surface to be cleaned to the dust collecting chamber, a neck arranged between the suction head and the housing to connect the suction head to the housing, a switch device configured to be pressed to separate the neck from the housing, f the switch device being arranged at a rear side of the neck, and a locking member configured to lock the switch device by being in contact with the switch device, so as to prevent the neck and the housing from being separated from each other at a position in which the neck is inclined with respect to the suction head.

DESCRIPTION OF THE DRAWINGS

These and/or other aspects of the disclosure will become apparent and more readily appreciated from the following description of embodiments, taken in conjunction with the accompanying drawings.

DETAILED DESCRIPTION

Figure 1:
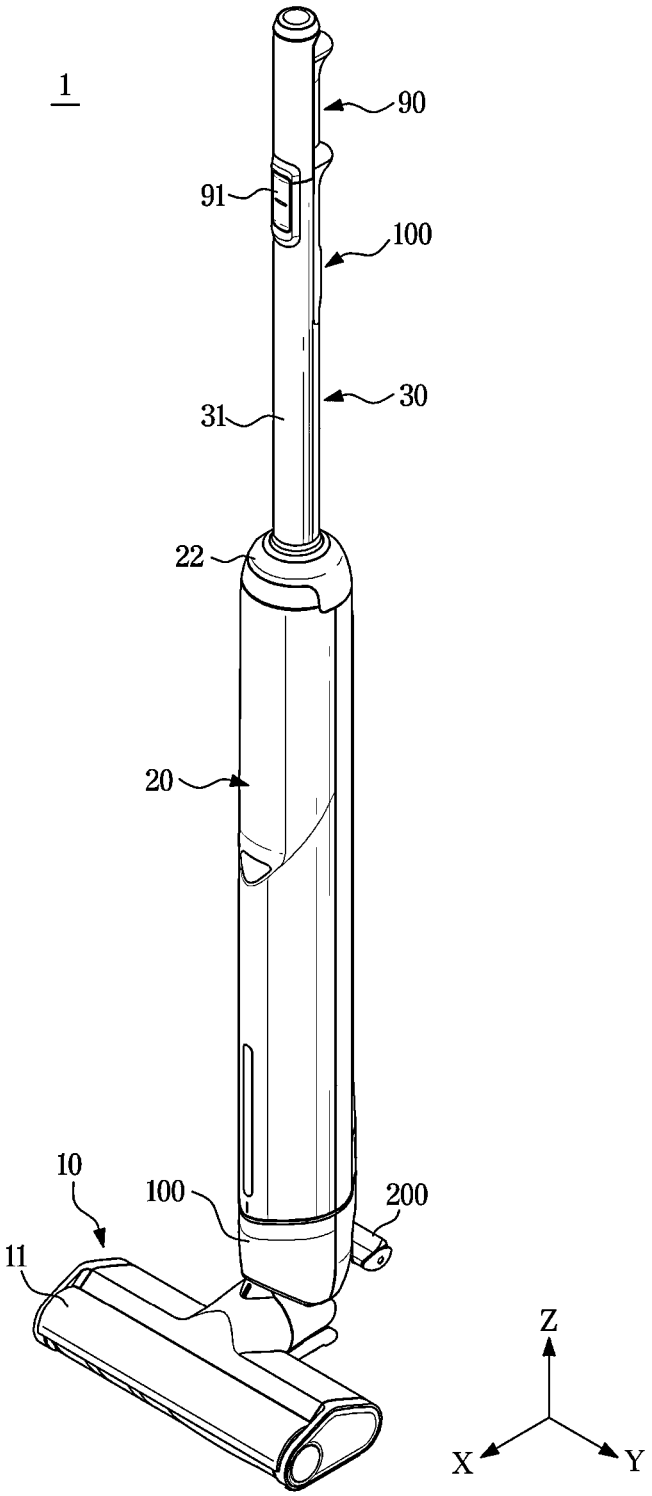
FIG. 1 is a perspective view illustrating a cleaner according to an embodiment of the disclosure.

Embodiments described in the disclosure and configurations illustrated in the drawings are merely examples of the embodiments of the disclosure, and may be modified in various different ways at the time of filing of the present application to replace the embodiments and drawings of the disclosure.

In addition, the same reference numerals or signs illustrated in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front side", "rear side", "left side", "right side" and the like may be defined by the drawings, but the shape and the location of the component is not limited by the term.

Therefore, it is an aspect of the disclosure to provide a cleaner capable of easily separating a housing from a suction head.

It is another aspect of the disclosure to provide a cleaner capable of preventing a housing from easily separating from a suction head during use of the cleaner.

It is another aspect of the disclosure to provide a cleaner having improved aesthetics.

Additional aspects of the disclosure will be set forth in part in the description which follows and, in part, will be obvious from the description, or may be learned by practice of the disclosure. Hereinafter an embodiment according to the disclosure will be described in detail with reference to the accompanying drawings. In FIG. 1, a portion in which a head assembly 10 is arranged may be defined as a front side, and a portion in which a handle 90 is arranged may be defined as a rear side. That is, it may be defined that air is introduced from the front side of a cleaner 1 and discharged to the rear side. However, the shape and position of each component is not limited by the terms defined in this way.

Figure 2:
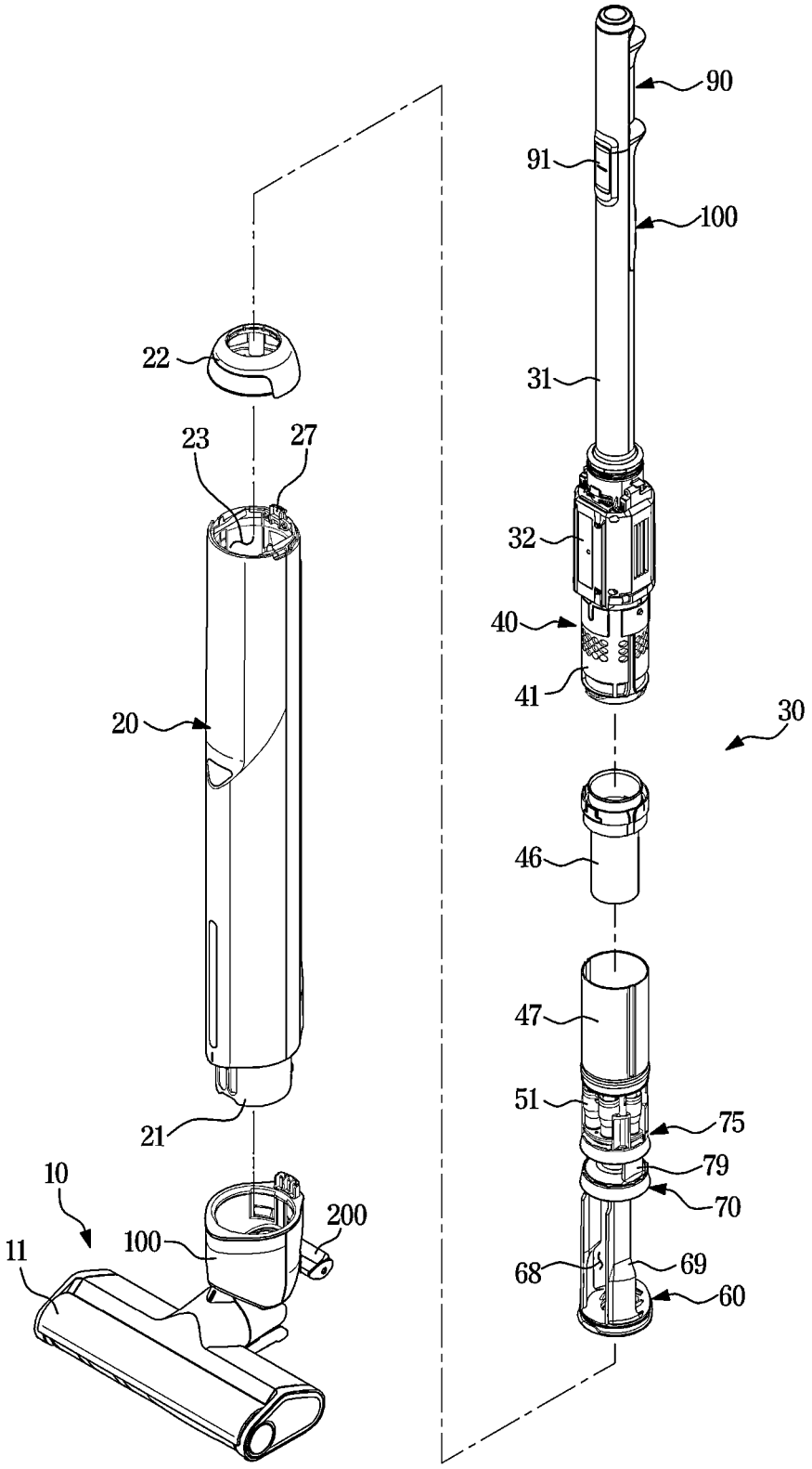
FIG. 2 is an exploded-perspective view illustrating the cleaner illustrated in FIG. 1.
Figure 3:
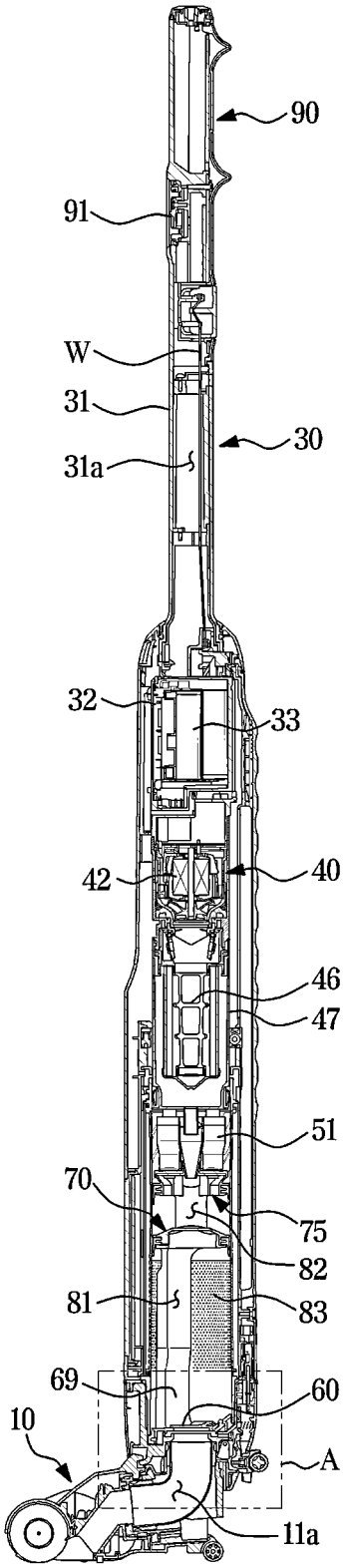
FIG. 3 is a cross-sectional view illustrating the cleaner illustrated in FIG. 1.

FIG. 1 is a perspective view illustrating a cleaner according to an embodiment of the disclosure. FIG. 2 is an exploded-perspective view illustrating the cleaner illustrated in FIG. 1. FIG. 3 is a cross-sectional view illustrating the cleaner illustrated in FIG. 1.

Referring to FIGS. 1 to 3, the cleaner 1 may include a head assembly 10, a housing 20 coupled to the head assembly 10, and a main body 30 movably provided inside the housing 20.

The head assembly 10 may include a suction head 11 provided to suck rubbish, such as hair on a surface to be cleaned, by a suction force of air. The suction head 11 is provided to suck rubbish such as dust placed on a surface to be cleaned while moving on the surface to be cleaned. The head assembly 10 may include the suction head 11, a neck 100, and a switch device 200.

An air flow path 11*a* may be formed inside the suction head 11. The air flow path 11*a* formed inside the suction head 11 may communicate with the housing 20 through the neck 100. Outside air and rubbish introduced through the suction head 11 may be moved into the housing 20 through the neck 100.

The neck 100 may be coupled to a lower end of the housing 20. The neck 100 may be coupled to the housing 20 through the switch device 200. For example, in the neck 100, a coupling protrusion 231 provided in the switch device 200 may be fastened to a fastening protrusion 21*a* provided in a lower end of the housing (refer to FIG. 4).

The neck 100 may be rotatably coupled to the suction head 11. As the neck 100 is rotated about the suction head 11, the suction head 11 may be rotated about the housing 20 connected to the neck 100. Accordingly, a degree of freedom of the driving the cleaner 1 may be improved.

The switch device 200 is configured to fix or release a coupling state between the head assembly 10 and the housing 20. For example, the switch device 200 may couple the head assembly 10 to the housing 20 or separate the housing 20 from the head assembly 10. A user may operate the switch device 200 to separate the housing 20 from the head assembly 10. The switch device 200 may be arranged on one side of the neck 100. For example, the switch device 200 may be arranged in a rear side of the neck 100. As the switch device 200 is arranged on the head assembly 10, the user can separate the housing 20 from the head assembly 10 (for example, the suction head 11) by operating the switch device 200 using the foot without bending at the waist.

The housing 20 may form a portion of an exterior of the cleaner 1. One end 21 of the housing 20 may be mounted to the head assembly 10. Particularly, the one end 21 of the housing 20 may be mounted to the neck 100. The main body 30 may be movably fixed to other end 22 of the housing 20. The housing 20 may include a hollow 22 formed to allow the main body 30 to be movably inserted therein, and a fixing portion 27 formed on the other end 22 of the housing 20. The main body 30 may be received in the housing 20. For example, the main body 30 may be inserted into the hollow 23. The fixing portion 27 may couple the main body 30 to the housing 20 so as to fix the main body 30 and the housing 20.

The main body 30 may be slidably coupled to the housing 20. It is possible to separate the main body 30 from the housing 20 to discharge rubbish, which is filtered out in dust collecting chambers 81 and 82 arranged in the main body 30, to the outside. With respect to the housing 20, the main body 30 may be movable between a first position for closing the dust collecting chambers 81 and 82 and a second position for opening the dust collecting chambers 81 and 82.

The main body 30 may include an extended portion 31 forming a part of an exterior of the cleaner 1. A space 31*a* provided to receive an electric wire extending toward an operation switch 91 may be formed inside the extended portion 31. In the space 31*a*, a wire W provided to connect a fixing release button (not shown) to a fixing device (not shown) may be received.

The main body 30 may include the handle 90. The handle 90 may be arranged at the rear of the extended portion 31. The handle 90 may be arranged at the other end opposite to one end at which an opening and closing device 60 of the main body 30 is arranged. For example, the opening and closing device 60 may be arranged on the lower end of the main body 30, and the handle 90 may be arranged on an upper end of the main body 30. When a user uses the cleaner 1, the user may push or pull the head assembly 10 by gripping the handle 90.

The handle 90 may be provided with the operation switch 91 for controlling an operation of the cleaner 1. The operation switch 91 is provided to receive a command for operating the cleaner 1 from the user. The operation switch 91 may be arranged adjacent to the handle 90 to allow the user to operate the cleaner 1 while the user moves the cleaner 1. For example, the operation switch 91 may be arranged in the front side of the handle 90.

The main body 30 may include a battery mounting portion 32. A battery 33 may be mounted in the battery mounting portion 32. One or two or more batteries 33 may be provided. The battery mounting portion 32 may be located inside the housing 20.

The main body 30 may be provided with the fan motor unit 40 configured to generate a suction force necessary to suck rubbish on a surface to be cleaned. The fan motor unit 40 may be configured to introduce outside air through the head assembly 10 and discharge the suctioned air through a discharge port (not shown) arranged on a rear surface of the housing 20. The fan motor unit 40 in a state of being mounted on the main body 30 may be arranged inside the housing 20. The fan motor unit 40 may include a fan motor 42.

A motor filter 46 may be provided in the main body 30. The motor filter 46 may be provided to once again filter out the rubbish in the air before being introduced into the fan motor unit 40. The motor filter 46 may be arranged in front of the fan motor unit 40 along a direction in which the air passing through a rubbish separation device 51 is discharged. The motor filter 46 may be arranged between the fan motor unit 40 and the rubbish separation device 51. The motor filter 46 may filter out rubbish from the air passing through the rubbish separation device 51. The motor filter 46 may be provided as a mesh member.

The motor filter 46 may be detachably mounted to a filter case 47. The motor filter 46 in a state of being mounted on the filter case 47 of the main body 30 may be arranged inside the housing 20. The motor filter 46 of the cleaner 1 according to an embodiment of the disclosure may prevent the fan motor unit 40 from being damaged by rubbish or the like, and allow relatively clean air to be discharged.

The dust collecting chambers 81 and 82 may be formed inside the housing 20. The dust collecting chambers 81 and 82 may be provided in plural. The plurality of dust collecting chambers 81 and 82 may include a first dust collecting chamber 81 and a second dust collecting chamber 82. In addition, a filtering device 83 may be provided inside the housing 20. The first dust collecting chamber 81 may collect rubbish that is filtered out when air, which is introduced through the head assembly 10, passes through the filtering device 83 through the neck 100.

Air passing through the filtering device 83 may be secondarily filtered by the rubbish separation device 51. The rubbish filtered out by the rubbish separation device 51 may be collected in the second dust collecting chamber 82. The air filtered in the rubbish separation device 51 may be moved toward the motor filter 46.

The main body 30 may include the rubbish separation device 51. The rubbish separation device 51 may include a cyclone. The rubbish separation device 51 may separate rubbish, which is not filtered out in the first dust collecting chamber 81, from the air by using a centrifugal force. Because the rubbish separation device 51 separates the rubbish from the air passing through the filtering device 83 in a different way from the filtering device 83, the cleaner according to an embodiment of the disclosure may increase the cleaning efficiency.

The cleaner according to an embodiment of the disclosure may be provided such that a portion of the main body 30, in which the fan motor unit 40 is arranged, is partitioned from the battery mounting portion 32. That is, air flowing by the fan motor unit 40 may not be moved to the battery mounting portion 32 and the handle 90, but directly discharged through a motor discharge port 41 and a discharge port (not shown) of the housing 20. Accordingly, the cleaner according to an embodiment of the disclosure may minimize the discharge of the air toward the user.

The main body 30 may include the opening and closing device 60 configured to open and close the first dust collecting chamber 81. The opening and closing device 60 may be arranged at an end portion of the main body 30 facing the head assembly 10. For example, the opening and closing device 60 may be arranged on the lower end portion of the main body 30.

The main body 30 may include a first rubbish removing member 70 provided to discharge the rubbish from the first dust collecting chamber 81. The first rubbish removing member 70 may be provided to slide on the first dust collecting chamber 81. A first rubbish removing portion 72 may be composed of a material having elasticity. The first rubbish removing portion 72 may be formed to be in close contact with an inner wall of the filtering device 83. The first rubbish removing portion 72 may be provided to be in close contact with one surface, on which rubbish is filtered out, of the filtering device 83. In response to the main body 30 sliding with respect to the housing 20, the first rubbish removing portion 72 may slide while being in close contact with the inner surface of the filtering device 83. In response to the main body 30 being moved to the inside of the housing 20, the first dust removing portion 72 may scrape the inner surface of the filtering device 83 and remove the rubbish, such as hair, tangled on the inner surface of the filtering device 83.

The first rubbish removing member 70 may be moved from a first position between the filtering device 83 and the rubbish separation device 51 to a second position protruding to the outside of the housing 20. Accordingly, the first rubbish removing member 70 may discharge the rubbish collected in the first dust collecting chamber 81 to the outside. In addition, because the first rubbish removing member 70 protrudes to the outside of the housing 20, dust collected in the second dust collecting chamber 82 may also be discharged to the outside.

The main body 30 may include a first connection portion 69 provided to connect the first rubbish removing member 70 to the opening and closing device 60. The first connection portion 69 may be arranged in the first dust collecting chamber 81. The first rubbish removing member 70 may be interlocked with the opening and closing device 60 by the first connection portion 69.

A discharge opening 68 may be formed between the plurality of first connection portions 69. The discharge opening 68 may be formed between the first rubbish removing member 70 and the opening and closing device 60. In response to the opening and closing device 60 opening the first dust collecting chamber 81 and in response to the first rubbish removing member 70 discharging the rubbish from the first dust collecting chamber 81, the rubbish may be discharged to the outside through the discharge opening 68.

The main body 30 may include a second rubbish removing member 75 provided to discharge the rubbish from the second dust collecting chamber 82. The second rubbish removing member 75 may be provided to slide on the second dust collecting chamber 82 and the first dust collecting chamber 81. The second dust collecting chamber 82 may be formed between the first rubbish removing member 70 and the second rubbish removing member 75.

The main body 30 may include a second connection portion 79 provided to connect the first rubbish removing member 70 to the second rubbish removing member 75. The second connection portion 79 may be arranged in the second dust collecting chamber 82. The second rubbish removing member 75 may be interlocked with the first rubbish removing member 70 by the second connection portion 79.

Figure 4:
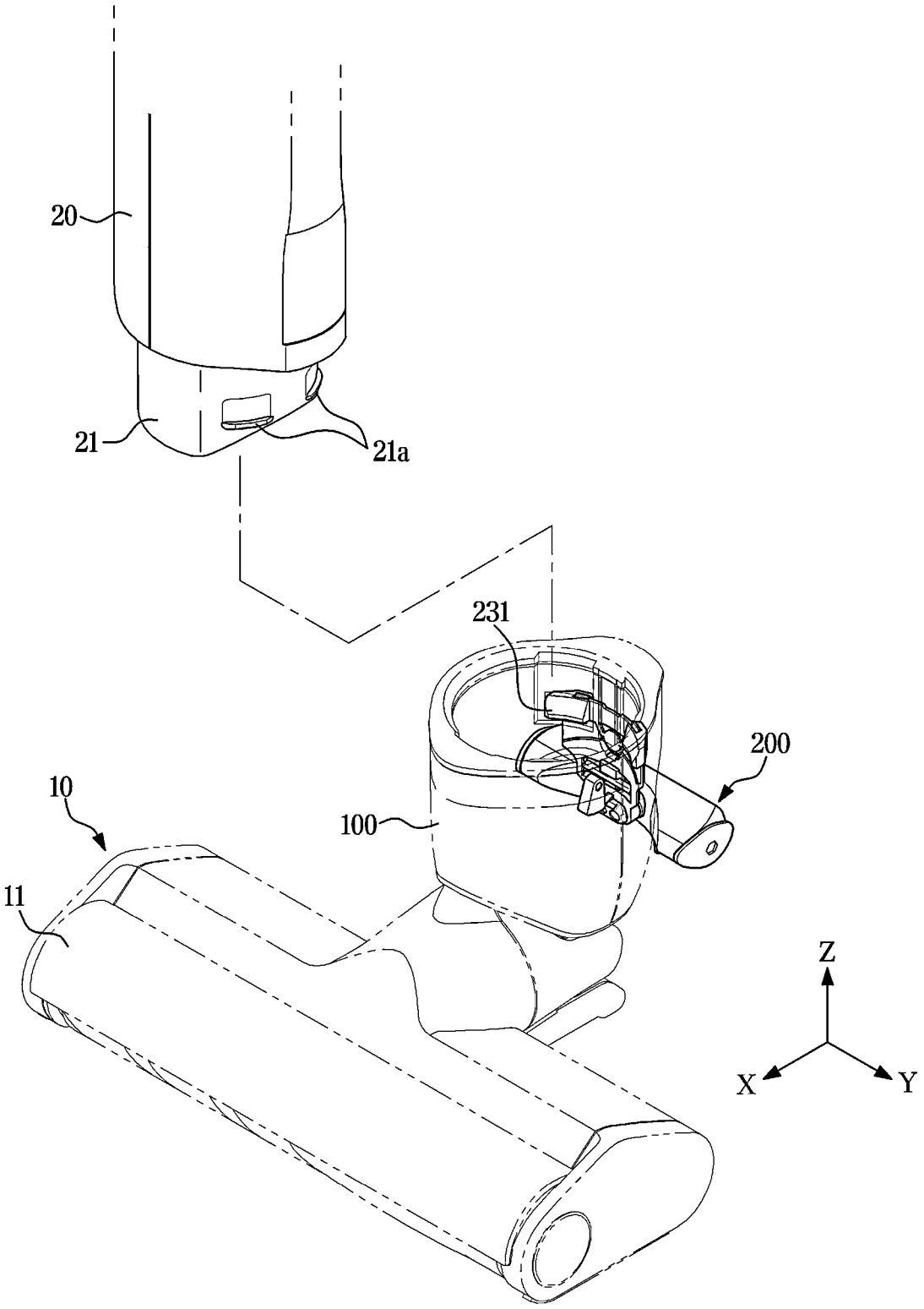
FIG. 4 is a perspective view illustrating a coupling structure of a housing and a neck in the cleaner illustrated in FIG. 1.

FIG. 4 is a perspective view illustrating a coupling structure of the housing 20 and the neck 100 in the cleaner illustrated in FIG. 1.

Referring to FIG. 4, according to an embodiment of the disclosure, the housing 20 may be connected to the head assembly 10. The neck 100 may be respectively coupled to the housing 20 and the suction head 11 so as to connect the housing 20 to the suction head 11. For example, the one end 21 of the housing 20 may be coupled to the neck 100.

The housing 20 may include the fastening protrusion 21*a*. The fastening protrusion 21*a* may be formed on the one end 21 of the housing 20. The fastening protrusion 21*a* may protrude from one end of the housing 20 in an −X direction. For example, the fastening protrusion 21*a* may protrude rearward from one end of the housing 20. The fastening protrusion 21*a* may be fastened to the coupling protrusion 231 provided on the switch device 200. In response to the fastening protrusion 21*a* being coupled to the coupling protrusion 231, the fastening protrusion 21*a* may be arranged under the coupling protrusion 231. Accordingly, the housing 20 may be coupled to the switch device 200. Because the switch device 200 is coupled to the neck 100, the neck 100 may be coupled to the housing 20.

Figure 5:
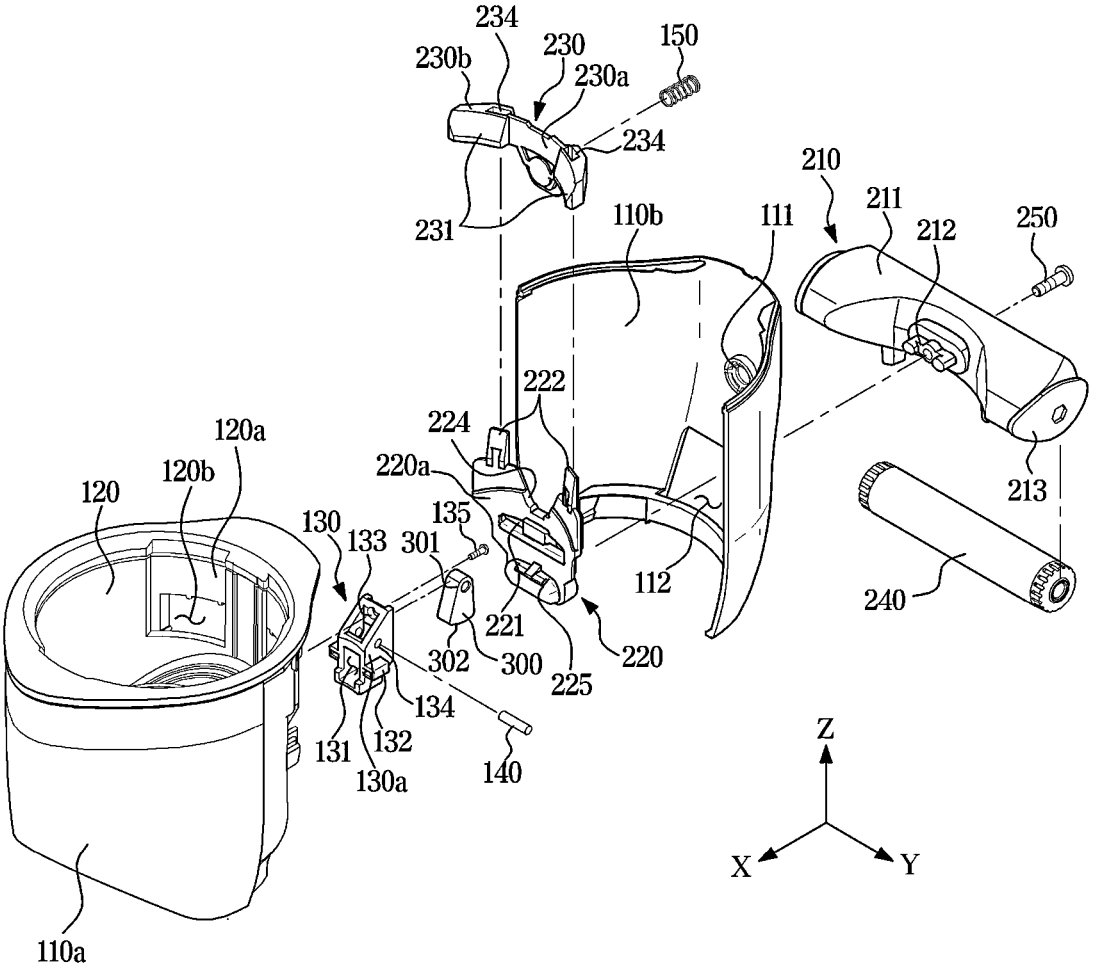
FIG. 5 is an exploded-perspective view illustrating the neck of the cleaner illustrated in FIG. 1.
Figure 6:
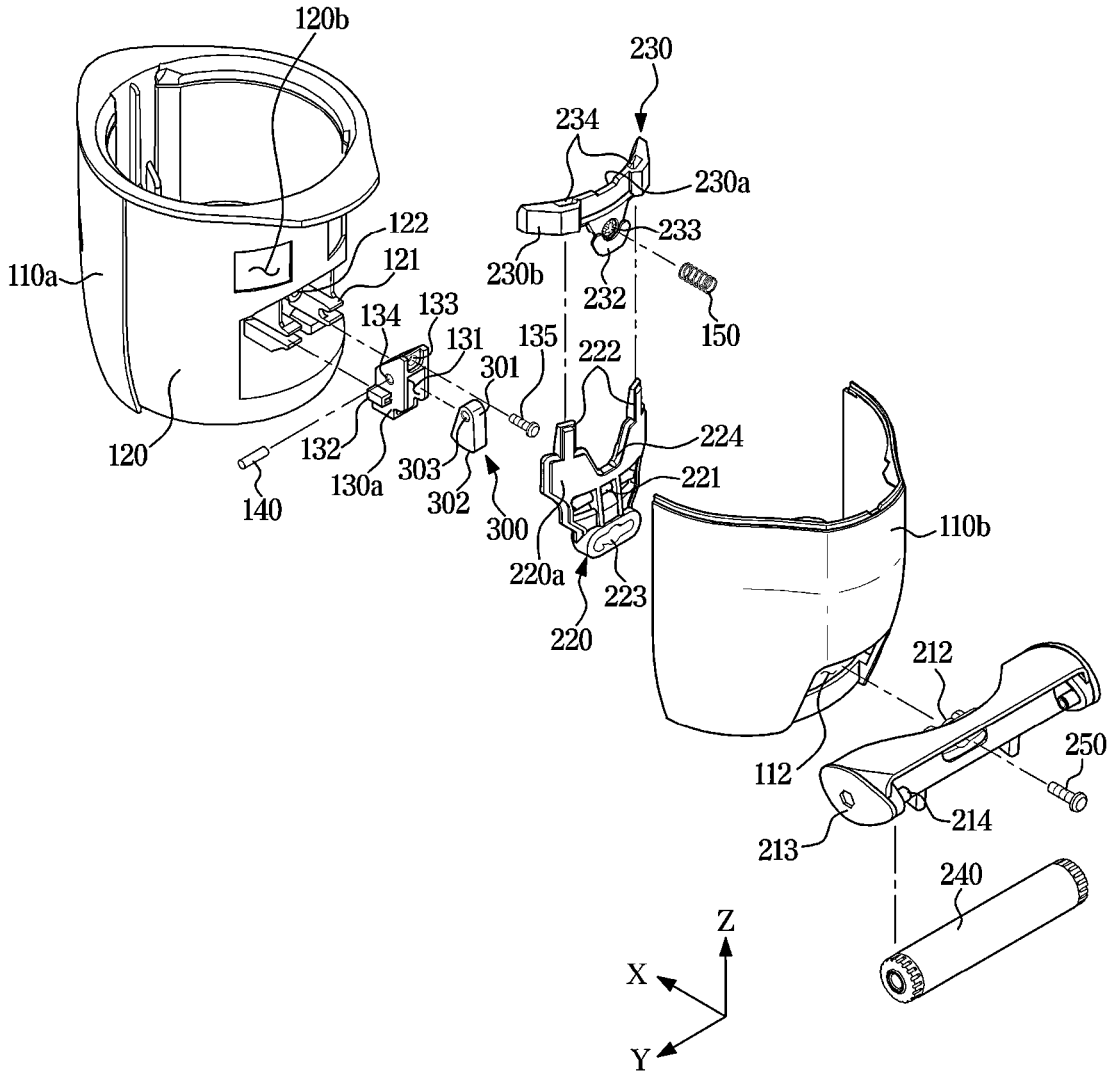
FIG. 6 is an exploded-perspective view illustrating the neck of the cleaner illustrated in FIG. 5 when viewed from another angle.

FIG. 5 is an exploded-perspective view illustrating the neck 100 of the cleaner illustrated in FIG. 1. FIG. 6 is an exploded-perspective view illustrating the neck 100 of the cleaner illustrated in FIG. 5 when viewed from another angle.

Referring to FIGS. 5 and 6, the neck 100 according to an embodiment of the disclosure may include an outer case 110 and an inner case 120 provided inside the outer case 110. The outer case 110 and the inner case 120 may be provided in a substantially cylindrical shape.

The outer case 110 may include a first case portion 110*a* and a second case portion 110*b*. The first case portion 110*a* may be arranged in an X direction, and the second case portion 110*b* may be arranged in the −X direction. For example, the first case portion 110*a* may be provided on the front side, and the second case portion 110*b* may be provided on the rear side. The second case portion 110*b* may include an elastic member receiving portion 111 provided to receive an elastic member 150 between the second case portion 110*b* and the inner case 120. For example, the elastic member receiving portion 111 may be provided in a rear portion of the outer case 110. In addition, the elastic member receiving portion 111 may protrude from the rear portion of the outer case 110 toward the front side to receive the elastic member 150. The second case portion 110*b* may include a penetrating portion 112.

The penetrating portion 112 may be provided as an opening to allow an insertion protrusion 212 of a switch button 210 to be inserted into an insertion groove 223 of a first switch member 220.

The inner case 120 may be arranged inside the outer case 110. The inner case 120 may include a recessed portion 120*a* and a through hole 120*b*. The recessed portion 120*a* may be formed by being recessed from the inner surface of the inner case 120. The recessed portion 120*a* may be provided in a shape corresponding to the lower end 21 of the housing 20. The through hole 120*b* may be formed to penetrate the recessed portion 120*a*. In response to the housing 20 being coupled to the neck 100, the coupling protrusion 231 of the second switch member 230 may pass through the through hole 120*b* and then be fastened to the coupling protrusion 21*a* of the housing 20. The recessed portion 120*a* and the through hole 120*b* may be provided on the −X direction side of the inner case 120. For example, the recessed portion 120*a* and the through hole 120*b* may be provided in a rear portion of the inner case 120. The recessed portion 120*a* and the through hole 120*b* may be provided in plural. For example, two recessed portions 120*a* and two through holes 120*b* may be provided. However, the number of the recessed portion 120*a* and the through-holes 120*b* is not limited thereto.

The inner case 120 may include a shaft mounting portion 121 and a screw groove 122. The shaft mounting portion 121 may be formed to correspond to a shaft 221 to be coupled to the shaft 221 of the first switch member 220. For example, the shaft mounting portion 121 may be provided in the rear portion of the inner case 120. The shaft mounting portion 121 may be provided to support the shaft 221. For example, the shaft mounting portion 121 may include two mounting portions protruding rearward and in which a middle portion of the shaft mounting portion 121 is recessed. However, the shape and/or the number of the shaft mounting portion 121 is not limited to the above example. The screw groove 122 may be coupled to a screw 135 to couple a holder 130 to the inner case 120.

The neck 100 according to an embodiment of the disclosure may further include the holder 130, a rotating shaft 140, and the elastic member 150.

The holder 130 may be provided outside a rotating member 300. The holder 130 may allow the rotating member 300 to be rotated smoothly within the inner case 120. The holder 130 may prevent the rotating member 300 from being separated from the inner case 120. The holder 130 may be mounted on the cases 110 and 120. For example, the holder 130 may be mounted on the inner case 120 to couple the rotating member 300 to the inner case 120. The holder 130 may include a holder body 130*a*, a receiving portion 131, a case coupling portion 132, a mounting hole 133, a shaft coupling portion 134, and the screw 135.

The receiving portion 131 may be formed inside the holder body 130*a*. For example, the receiving portion 131 may be formed in a middle portion of the holder body 130*a*. The receiving portion 131 may be hollow in the holder body 130*a*. The receiving portion 131 may receive the rotating member 300 to allow the rotating member 300 to be naturally rotated according to gravity during use of the cleaner. A portion of the rotating shaft 140 may be received in an upper portion of the receiving portion 131.

The case coupling portion 132 may be provided on opposite sides of the holder body 130*a*. That is, the case coupling portion 132 may be provided in plural. The case coupling portion 132 may protrude from the holder body 130*a* to opposite sides to allow the holder 130 to be mounted on the inner case 120. For example, the case coupling portion 132 may protrude from the holder body 130*a* in a Y direction and/or a −Y direction. A holder coupling portion (not shown) corresponding to the case coupling portion 132 may be provided in the inner case 120. The holder coupling portion may be provided under the shaft mounting portion 121.

The mounting hole 133 may be provided at an upper portion of the holder body 130*a*. The mounting hole 133 may allow the screw 135 to pass therethrough. The screw 135 may pass through the mounting hole 133 so as to be coupled to the screw groove 122 provided in the inner case 120. The screw 135 may be inserted into the screw groove 122 in the X direction. For example, the screw 135 may be inserted into the screw groove 122 toward the front. Accordingly, the screw 135 may allow the holder 130 to be coupled to the inner case 120.

The shaft coupling portion 134 may be provided to allow the rotating shaft 140 to be coupled to the holder body 130*a*. The shaft coupling portion 134 may penetrate the holder body 130*a*.

The rotating shaft 140 may be coupled to the rotating member 300 and the holder 130. The rotating shaft 140 may be coupled to the shaft coupling portion 303 of the rotating member 300 and the shaft coupling portion 134 of the holder 130, respectively. The rotating shaft 140 may allow the rotating member 300 to be rotatably coupled to the holder 130. The rotating shaft 140 may be received in the inner case 120.

The elastic member 150 may be arranged between the inner case 120 and the outer case 110. Further, the elastic member 150 may be arranged between the second switch member 230 and the second case portion 110*b*. The elastic member 150 may be arranged above the shaft 221. Accordingly, the elastic member 150 may elastically press the switch member 220 and 230 to allow the plurality of switch members 220 and 230 to return to a process that is before the process in which the neck 100 and the housing 20 are separated from each other. Details will be described later.

The cleaner 1 according to an embodiment of the disclosure may include the switch device 200. The switch device 200 is configured to couple the housing 20 to the head assembly 10 or to separate the housing 20 from the head assembly 10. For example, the switch device 200 may couple the housing 20 to the neck 100 or separate the housing 20 from the neck 100. A user may separate the housing 20 from the neck 100 by stepping on the switch device 200 with a foot. The switch device 200 may be arranged at the rear of the neck 100. Accordingly, the user may separate the housing 20 from the head assembly 10 (e.g., the neck 100) by operating the switch device 200 using the foot without bending at the waist.

The switch device 200 may include the switch button 210 and switch members 220 and 230. The switch button 210 may be provided at the rear of the neck 100 to be pressed by the user. Because the switch button 210 is provided on the outside of the neck 100 (e.g., the rear of the neck 100), the user can easily separate the neck 100 and the housing 20 by stepping on the switch button 210 with the feet. The switch button 210 may include a pushing portion 211, the insertion protrusion 212, a cover member 213, and a connection shaft 214.

The pushing portion 211 may be pushed by a user. The pushing portion 211 may extend in the Y direction and/or the −Y direction to be pressed by the user. For example, the user may press the pushing portion 211 in a −Z direction (e.g., downward direction). The shape of the pushing portion 211 is not limited to the illustrated example.

The insertion protrusion 212 may protrude in the X direction to be inserted into the first switch member 220. For example, the insertion protrusion 212 may protrude toward the front side. The insertion protrusion 212 may be inserted into the insertion groove 223 of the first switch member 220. The insertion protrusion 212 may include a plurality of protrusion shapes. However, the shape of the insertion protrusion 212 is not limited to that illustrated in the drawings.

The cover member 213 may be coupled to opposite ends of the pushing portion 211 to cover the opposite ends of the pushing portion 211. The connection shaft 214 may protrude toward an inside of the switch button 210 to allow a wheel 240, which is mounted on the switch button 210, to be coupled thereto. The connection shaft 214 may protrude in the −Y direction and/or the Y direction.

The switch members 220 and 230 may be coupled to the switch button 210 to allow the housing 20 and the neck 100 to be coupled to each other and/or separated from each other. The switch members 220 and 230 may be arranged between the inner case 120 and the outer case 110. That is, the switch members 220 and 230 may be received in the cases 110 and 120. The switch members 220 and 230 may be provided in plural. The plurality of switch members 220 and 230 may include the first switch member 220 and a second switch member 230.

The first switch member 220 may be coupled to the switch button 210. The first switch member 220 may be arranged under the second switch member 230. The first switch member 220 may include a body 220*a*, the shaft 221, an insertion portion 222, the insertion groove 223, a first coupling portion 224, and a contact portion 225.

The shaft 221 may be provided in a middle portion of the body 220*a*. The shaft 221 may allow the plurality of switch members 220 and 230 to be rotated according to whether the switch button 210 is pressed. The shaft 221 may be coupled to the shaft coupling portion 134. The shaft 221 may be supported by the shaft coupling portion 134. The switch members 220 and 230 may be rotated by the shaft 221, and thus the housing 20 and the neck 100 may be coupled to each other or separated from each other. Details will be described later.

The insertion portion 222 may be provided in an upper portion of the body 220*a*. The insertion portion 222 may extend in a Z direction (e.g., upward direction) and be inserted into an insertion hole 234 of the second switch member 230. The insertion portion 222 may be placed in the insertion hole 234. The insertion portion 222 may be inserted into the second switch member 230.

The insertion groove 223 may correspond to the insertion protrusion 212 of the switch button 210. The insertion groove 223 may be a recess 223 to receive the insertion protrusion 212. Because the insertion groove 223 is coupled to the insertion protrusion 212, the switch button 210 may be systematically coupled to the first switch member 220, and the switch device 200 may be simultaneously rotated according to whether the user presses the pushing portion 211.

The first coupling portion 224 may be coupled to the second coupling portion 232 of the second switch member 230. In addition, the first coupling portion 224 may be arranged under the second coupling portion 232 to be coupled to the second coupling portion 232. In addition, the first coupling portion 224 may be arranged in the front side than the second coupling portion 232. Accordingly, the first switch member 220 and the second switch member 230 may be systematically rotated and/or moved. In response to the first switch member 220 being coupled to the second switch member 230, the first coupling portion 224 may be placed in front of the second coupling portion 232. Details will be described later.

The contact portion 225 may be provided in a lower portion of the first switch member 220. The contact portion 225 may be in contact with the rotating member 300 in response to the neck 100 being separated from the housing 20, or in response to the neck 100 being in a second position P2. The second position P2 may be a position in which the neck 100 is inclined with respect to the suction head 11. The contact portion 225 may protrude from the lower portion of the body 220*a* of the first switch member 220 in the X-axis direction (e.g., forward).

The second switch member 230 may be coupled to the first switch member 220. Because the first switch member 220 is coupled to the switch button 210, the second switch member 230 may be rotated and/or moved according to whether the switch button 210 is pressed. The second switch member 230 may be provided above the first switch member 220 and the switch button 210. The second switch member 230 includes a body 230*a*, an extended portion 230*b*, the coupling protrusion 231 and the second coupling portion 232, an elastic member receiving portion 233, and the insertion hole 234.

The extended portion 230*b* may extend from a middle portion of the body 230*a* to opposite sides. The extended portion 230*b* may extend in the Y direction and/or the −Y direction. For example, the extended portion 230*b* may extend in a left and/or right direction.

The coupling protrusion 231 may allow the neck 100 and the housing 20 to be coupled to each other. The coupling protrusion 231 may be coupled to the fastening protrusion 21*a* of the housing 20. For example, in response to the coupling protrusion 231 being coupled to the fastening protrusion 21*a*, the coupling protrusion 231 may be arranged above the coupling protrusion 21*a* and the coupling protrusion 21*a* may be arranged below the coupling protrusion 231. The coupling protrusion 231 may protrude from the extended portion 230*b* in the X direction. For example, the coupling protrusion 231 may protrude forward from the extended portion 230*b*. The coupling protrusion 231 may protrude forward and be arranged inside the inner case 120. The coupling protrusion 231 may be provided in plural to allow the switch device 200 to be stably coupled to the housing 20. However, the number and/or shape of the coupling protrusion 231 is not limited to the example illustrated in the drawings or the example described above.

The second coupling portion 232 may be coupled to the first coupling portion 224 of the first switch member 220. Accordingly, the first switch member 220 and the second switch member 230 may be systematically rotated and/or moved. In response to the first switch member 220 being coupled to the second switch member 230, the first coupling portion 224 may be placed in front of the second coupling portion 232. Accordingly, in response to the first coupling portion 224 being rotated rearward (clockwise in the drawing) according to the rotation of the shaft 221, the second coupling portion 232 arranged at the rear of the first coupling portion 224 may be rotated accordingly. Therefore, the first switch member 220 and the second switch member 230 may be systematically rotated.

The elastic member receiving portion 233 of the second switch member 230 may receive the elastic member 150 between the elastic member receiving portion 233 and the elastic member receiving portion 111 of the outer case 110. The elastic member receiving portion 233 may be formed on a rear surface of the body 230*a*. The insertion portion 222 of the first switch member 220 may be inserted into the insertion hole 234. Accordingly, the second switch member 230 and the first switch member 220 may be coupled to each other.

The switch device 200 may further include the wheel 240 and a fastener 250. The wheel 240 may be coupled to the switch button 210. The wheel 240 may assist the movement of the cleaner 1 during use of the cleaner 1. The fastener 250 may allow the first switch member 220 and the switch button 210 to be coupled to each other. The fastener 250 may be inserted into the insertion protrusion 212 and the insertion groove 223 in the X-direction (e.g., forward).

The cleaner 1 according to an embodiment of the disclosure may include the rotating member 300. The rotating member 300 may be rotatably coupled to the inner case 120. The rotating member 300 may be arranged between the inner case 120 and the outer case 110. Particularly, the rotating member 300 may be received in the holder 130. The rotating member 300 may be coupled to the holder 130 by the rotating shaft 140. The holder 130 may be coupled to the inner case 120 by the case coupling portion 132. Accordingly, the rotating member 300 may be rotated in the inner case 120 through the rotating shaft 140 according to the movement of the cleaner 1 and/or the neck 100. The rotating member 300 may include a first point 301 and a second point 302. For example, the first point 301 may be provided above the second point 302. A center of gravity may be arranged in a lower portion of the rotating member 300. For example, the rotating member 300 may be a mass body. The rotating member 300 may be referred to as a rotating body 300. The first point 301 may be an upper portion of the rotating body 300. The second point 302 may be a lower portion of the rotating body 300. A cross-sectional area of the rotating body 300 at the second point 302 may be greater than a cross-sectional area of the rotating body 300 at the first point 301. The rotating body 300 may prevent the housing 20 and the neck 100 from being separated, which is caused by the pressure of the switch device 200, during use of the cleaner 1. For example, in response to the neck 100 being in the second position P2, the rotating body 300 may lock the switching device 200 to prevent the neck 100 and the housing 20 from being separated from each other. The second position P2 may be a position in which the neck 100 is inclined with respect to the suction head 11. The rotating member 300 may be a locking member 300. Details will be described later.

Figure 7:
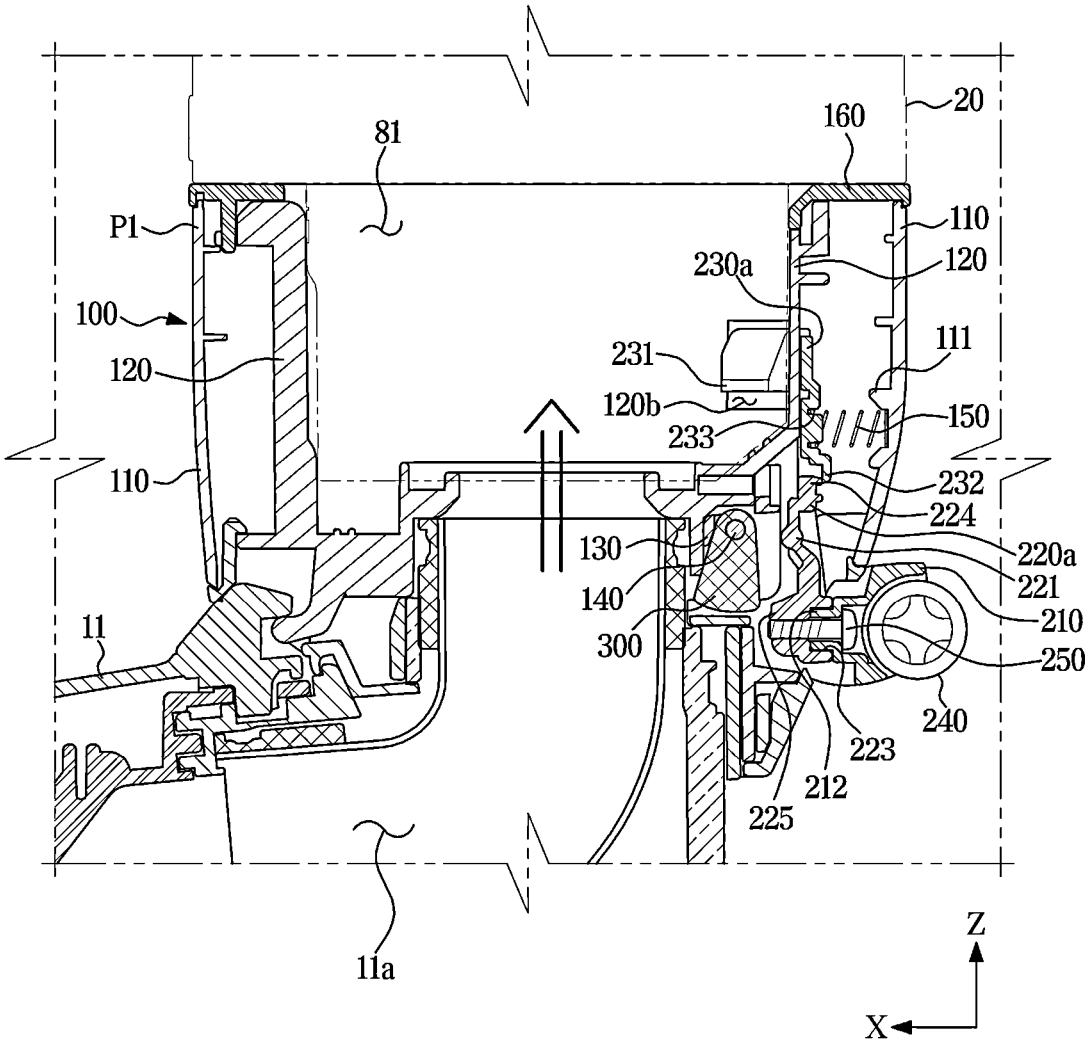
FIG. 7 is a cross-sectional view illustrating the neck of the cleaner illustrated in FIG. 3.
Figure 8:
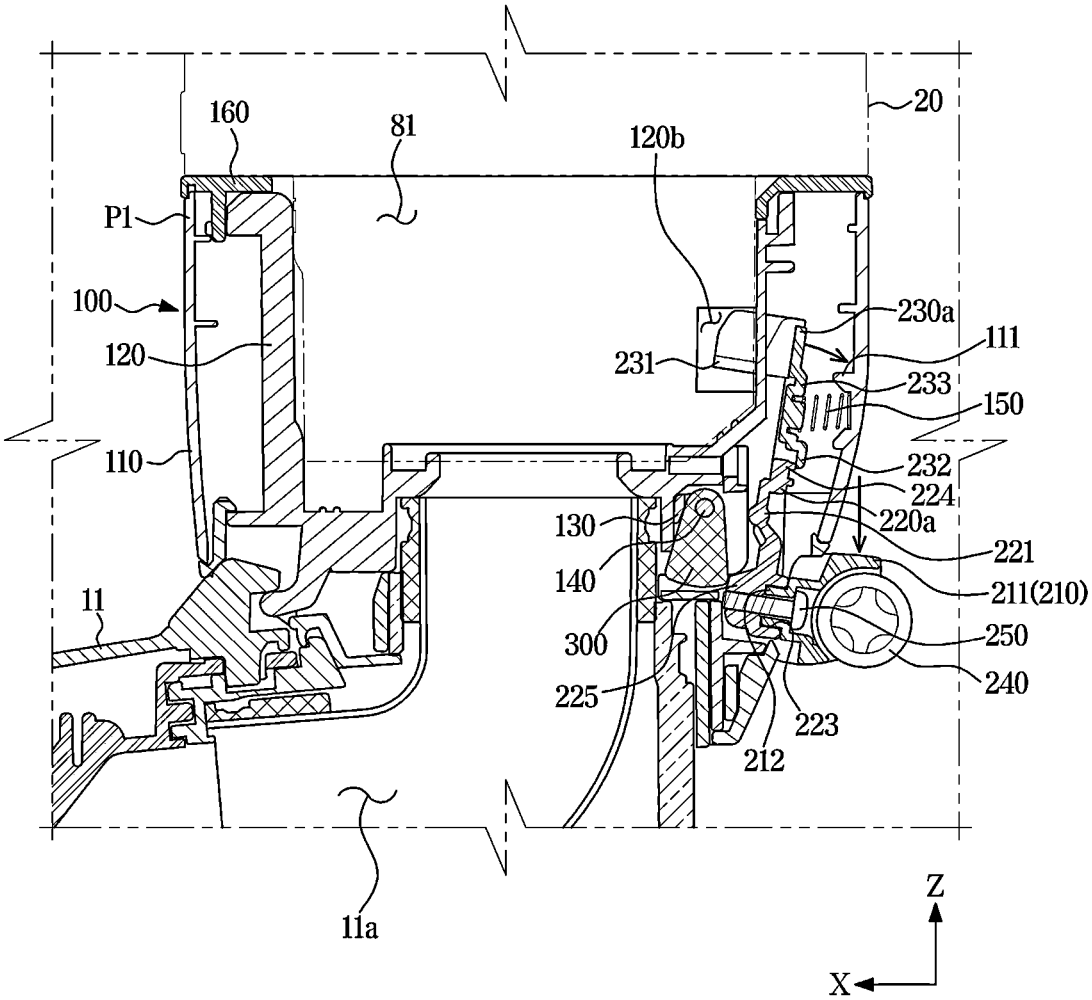
FIG. 8 is a cross-sectional view illustrating a process of separating the housing from the neck in the cleaner illustrated in FIG. 7.

FIG. 7 is a cross-sectional view illustrating the neck 100 of the cleaner illustrated in FIG. 3. FIG. 8 is a cross-sectional view illustrating a process of separating the housing 20 from the neck in the cleaner 100 illustrated in FIG. 7.

Referring to FIGS. 7 and 8, according to an embodiment of the disclosure, the neck 100 may include the first position P1 and the second position P2. For example, the neck 100 may be located in the first position P1 in which the neck 100 is separable from the housing 20 or the second position P2 in which the neck 100 is fixed to the housing 20. The first position P1 of the neck 100 may be a position in which the neck 100 is substantially perpendicular to the suction head 11. That is, an angle between the neck 100 and the suction head 11 may be approximately 90 degrees. In general, the angle between the neck 100 and the suction head 11 being approximately 90 degrees may indicate that the user stops using the cleaner. Therefore, in order that that the neck 100 and the housing 20 are separated from each in response to the operation of the cleaner being stopped, the neck 100 and the housing 20 may be separatable from each other in response to the neck 100 being in the first position P1. However, the cleaner 1 may be operated even when the neck 100 is in the first position P1. Accordingly, the air sucked into the cleaner 1, which is the air containing rubbish, may pass through the air flow path 11*a* and the first dust collecting chamber 81 sequentially.

According to an embodiment of the disclosure, in response to the neck 100 being in the first position P1, the rotating member 300 may not be in contact with the switch device 200. For example, in response to the neck 100 being in the first position P1, since the rotating member 300 may be not in contact with the first switch member 220, so the neck 100 may not be locked.

In response to the neck 100 being in the first position P1, the housing 20 and the neck 100 may be coupled to each other. For example, the fastening protrusion 21*a* and the coupling protrusion 231 may be fastened to each other. Although not illustrated in FIG. 7, the fastening protrusion 21*a* may be coupled to the coupling protrusion 231 under the coupling protrusion 231.

As illustrated in FIG. 8, the user may press the pushing portion 211. For example, the pushing portion 211 may be pressed downward by the user. At this time, the switch button 210 may be rotated (clockwise in the drawing) while being moved downward. That is, because the shaft 221 of the first switch member 220 is mounted on the shaft mounting portion 121, the switch button 210 may also be rotated in response to rotation of the shaft 221. In other words, the switch button 210 and the first switch member 220 may be rotated in association with each other by the user's pressure. In this case, the first switch member 220 may be in contact with a side surface of the rotating body 300. The first switch member 220 may push the rotating body 300 so as to rotate the rotating body 300 at a predetermined angle. Because the second switch member 230 and the first switch member 220 are coupled to each other by the coupling portions 224 and 232, the insertion portion 222 and the insertion hole 234, the second switch member 230 and the first switch member 220 may be rotated in association with each other. Accordingly, the coupling protrusion 231 may be separated from the through hole 120*b* in the −X direction (e.g., rearward). In this case, the fastening protrusion 21*a* and the coupling protrusion 231 may be separated from each other. In a state in which the coupling protrusion 231 is separated from the fastening protrusion 21*a* and separated from the through hole 120*b*, the housing 20 and the neck 100 may be separated from each other in response to the housing 20 being moved in the Z direction (e.g., upward) by the user. Accordingly, the user can easily separate the housing 20 from the neck 100 without bending at the waist and pressing the button. In addition, after separating the housing 20 from the neck 100, the user may easily treat the rubbish collected in the dust collecting chamber.

In response to the first switch member 220 and the second switch member 230 being rotated by pressing the pushing portion 211, the elastic member 150 provided in the upper portion of the second switch member 230 between the second switch member 230 and the outer case 110 may be compressed. That is, a compressive force may be generated in the elastic member 150. Accordingly, a force to return to an original state is generated in the elastic member 150, and thus the elastic member 150 may elastically press the second switch member 230. For example, the elastic member 150 may press the second switch member 230 in the X direction (e.g., forward) to allow the second switch member 230 to return to the state before the second switch member 230 presses the pushing portion 211. As a result, in response to the pressing of the pushing portion 211 being stopped by the user, the switch device 200 may return to the state, which is illustrated in FIG. 7, by the elastic member 150.

The cleaner may include a cover member 170 provided to cover an upper end of the cases 110 and 120 in a region in which the housing 20 and the neck 100 are coupled or separated between the housing 20 and the neck 100.

Figure 9:
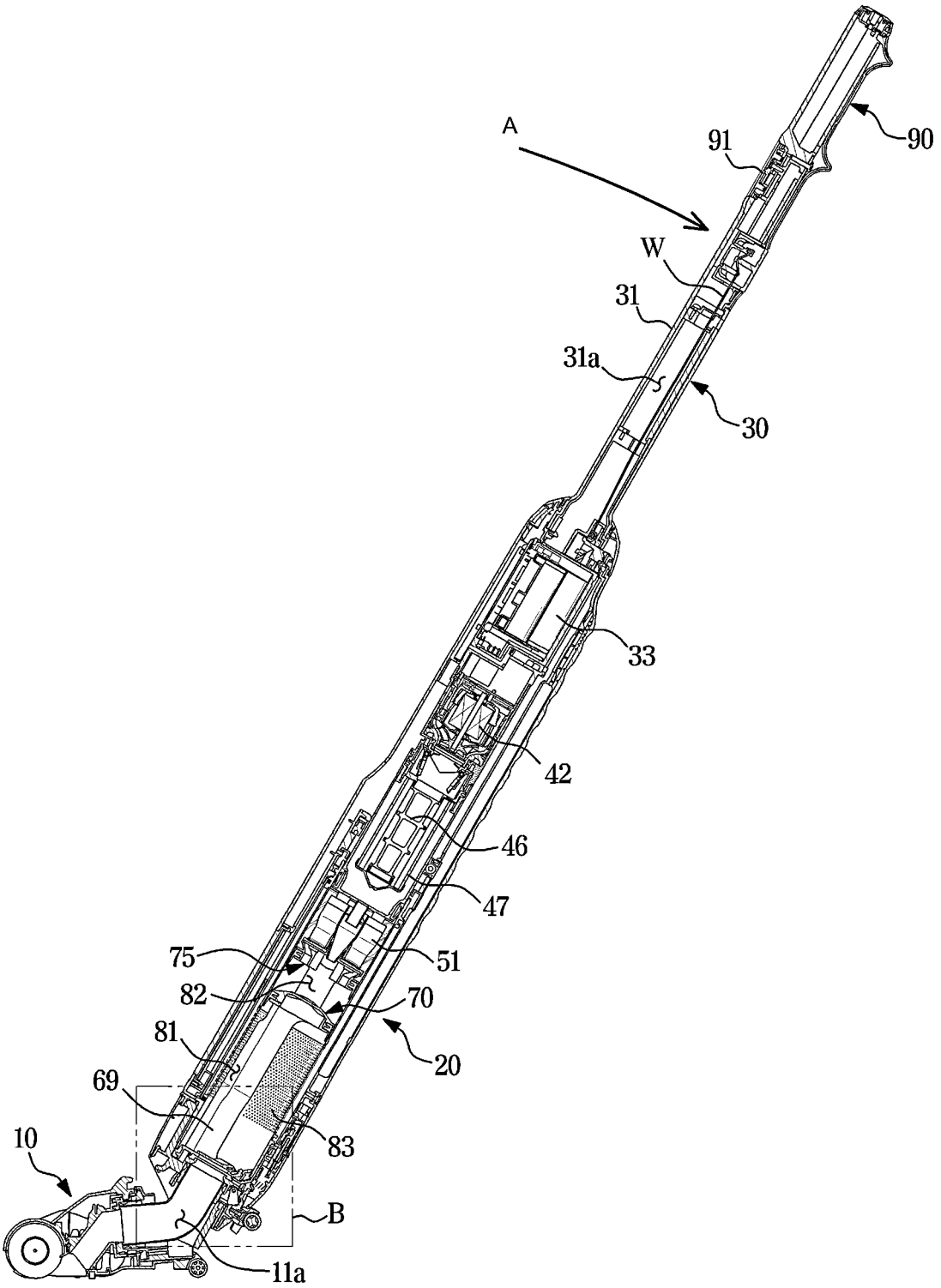
FIG. 9 is a cross-sectional view illustrating the cleaner illustrated in FIG. 1.
Figure 10:
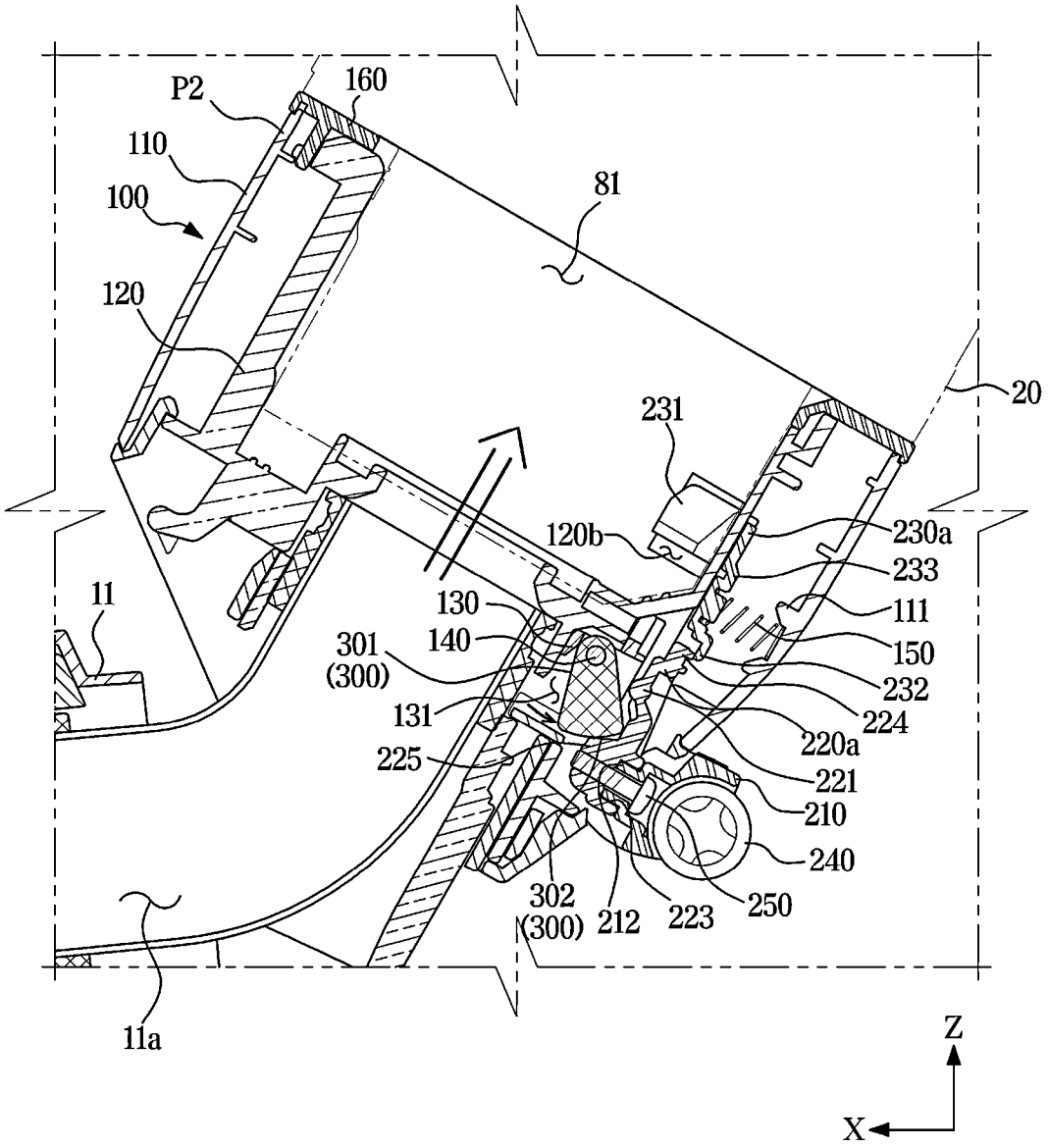
FIG. 10 is a cross-sectional view illustrating the neck of the cleaner illustrated in FIG. 9.

FIG. 9 is a cross-sectional view illustrating the cleaner illustrated in FIG. 1. FIG. 10 is a cross-sectional view illustrating the neck 100 of the cleaner illustrated in FIG. 9.

Referring to FIGS. 9 and 10, according to an embodiment of the disclosure, the second position P2 of the neck 100 may be a position in which the neck 100 is inclined with respect to the suction head 11. FIG. 9 illustrates the main body 30 inclined with respect to the head assembly 10, as illustrated with an arrow "A". The second position P2 may be a position in which the neck 100 is not substantially perpendicular to the suction head 11. For example, the angle between the neck 100 and the suction head 11 may be less than about 90 degrees. In response to the neck 100 being in the second position P2, the cleaner 1 may be operated. Accordingly, the air sucked into the cleaner 1, which is air containing rubbish, may pass through the air flow path 11*a* and the first dust collecting chamber 81 sequentially.

The rotating member 300 may be rotatably coupled to the holder 130 of the neck 100. The rotating member 300 may be rotated by gravity. Accordingly, the rotating member 300 may be rotated as the cleaner moves and the angle between the neck 100 and the suction head 11 is changed. In response to the neck 100 being in the second position P2, the rotating member 300 may be in contact with the switch device 200 to lock the switch device 200. For example, a lower surface 302 of the rotating member 300 may be in contact with the contact portion 225. The second point 302 of the rotating member 300 may correspond to the lower surface 302 of the rotating member 300. In response to the switch button 210 being pressed in a state in which the neck 100 is in an inclined position with the suction head 11, the first switch member 220 may press the lower surface 302 of the rotating member 300. For example, the contact portion 225 may be in contact with the lower surface 302 of the rotating member 300 to press the lower surface 302. However, in response to pressing the lower surface 302 of the rotating member 300, unlike pressing the side surface of the rotating member 300, the rotating member 300 may not be rotated and thus the switch button 210 and/or the switch member 220 and 230 may not be rotated. Accordingly, the switch device 200 may be locked.

The rotating member 300 may correspond to a locking member 300. The locking member 300 may lock the switch device 200 to prevent the housing 20 and the neck 100 from being separated. Therefore, in general, the switch button 210 may be pressed due to surrounding objects during the user uses the cleaner. Even in this case, the locking member 300 may lock the switch device 200, and thus the neck 100 and the housing 20 may not be separated, as illustrated in the drawings.

For example, the first switch member 220 may be in contact with the second point 302 of the rotating member 300. The second point 302 of the rotating member 300 may be provided to be inclined downward so as to have a larger cross-sectional area than the first point 301 of the rotating member 300. Because the cross-sectional area at the second point 302 of the rotating member 300 is larger than the cross-sectional area at the first point 301, the rotating member 300 may be easily rotated by gravity.

Because the switch device 200 is locked as the rotating member 300 is in contact with the first switch member 220, even if the user steps on the switch button 210 or the switch button 210 is pressed due to an object, the first switch member 220 and the second switch member 230 may not be rotated. Accordingly, it is possible to prevent an accident in which the housing 20 and the neck 100 are separated from each other unexpectedly. As a result, the user can easily perform cleaning without having to worry that the housing 20 and the neck 100 are unexpectedly separated.

As is apparent from the above description, a cleaner may easily separate a housing from a suction head by using a switch device arranged on one side of a neck.

Further, a cleaner may prevent a housing from separating from a suction head because a switch device is locked during use of the cleaner.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A cleaner comprising:

a housing to house:

a fan motor configured to generate a suction force, and a dust collecting chamber;

a suction head having an air flow path, the suction head being couplable to the housing so that while the suction head is coupled to the housing, foreign substance from a surface to be cleaned is guided along the air flow path, using the suction force generated by the fan motor, and collected in the dust collecting chamber;

a neck, arrangeable between the suction head and the housing, so that while the neck is arranged between the suction head and the housing, the neck connects the suction head to the housing, the neck being rotatable with respect to the suction head and couplable to and decouplable from the housing;

a switch device, arrangeable on one side of the neck, so that while the switch device is arranged on the one side of the neck, the switch device operates to couple the neck and the housing to each other and to decouple the neck and the housing from each other; and a rotating body, couplable to the neck, so that while the rotating body is coupled to the neck, the rotating body is inside of the neck and moveable due to gravity, wherein while the neck is at a first position with respect to the suction head the rotating body is in contact with the switch device to thereby lock the switch device to prevent the neck and the housing from being decoupled from each other, and while the neck is at a second position with respect to the suction head the rotating body is spaced apart from the switch device to thereby unlock the switch device to allow the neck and the housing to decouple from each other.

2. The cleaner of claim 1, wherein the neck comprises:

an outer case;

an inner case disposed inside of the outer case and configured to receive the rotating body between the inner case and the outer case;

a holder coupled to the rotating body and the inner case and configured to receive the rotating body; and a rotating shaft configured to rotatably couple the rotating body to the holder.

3. The cleaner of claim 2, wherein the rotating shaft is coupled to an upper portion of the rotating body, and a cross-sectional area of a lower portion of the rotating body is greater than a cross-sectional area of the upper portion of the rotating body, so that a center of gravity is positioned at the lower portion of the rotating body.

4. The cleaner of claim 3, wherein at the first position in which the neck is inclined with respect to the suction head, a lower surface of the rotating body is in contact with the switch device.

5. The cleaner of claim 4, wherein in response to rotation of the neck with respect to the suction head, the rotating body is rotated by gravity.

6. The cleaner of claim 1, wherein the switch device comprises:

a switch button provided outside the neck; and a switch member coupled to the housing and the switch button so that the housing and the neck are coupled to each other.

7. The cleaner of claim 6, wherein the switch member is provided in plural, and a plurality of switch members comprises:

a first switch member coupled to the switch button and in contact with a lower surface of the rotating body at the first position of the neck in which the switch button is locked; and a second switch member disposed above the first switch member to be coupled to the first switch member, and including a coupling protrusion protruding to an inside of the neck to be coupled to the housing.

8. The cleaner of claim 7, wherein the housing includes a fastening protrusion provided at a lower end of the housing fastened to the coupling protrusion of the second switch member, and the neck includes an outer case; and an inner case disposed inside of the outer case and configured to receive the plurality of switch members and the rotating body between the inner case and the outer case, wherein the coupling protrusion protrudes to an inside of the inner case and is fastened to the fastening protrusion.

9. The cleaner of claim 8, wherein the switch device is rotatably coupled to the inner case, wherein in response to the switch button being pressed at the second position of the neck in which the switch button is unlocked, the first switch member and the second switch member are rotated to allow the coupling protrusion and the fastening protrusion to separate from each other.

10. The cleaner of claim 9, wherein the second position of the neck in which the switch button is unlocked is a position in which the neck is perpendicular to the suction head.

11. The cleaner of claim 9, wherein the first position of the neck in which the switch button is locked is a position in which the neck is inclined with respect to the suction head, wherein in response to the switch button being pressed at the position in which the neck is inclined with respect to the suction head, the first switch member presses the lower surface of the rotating body.

12. The cleaner of claim 9, wherein the neck further comprises an elastic member disposed between the outer case and the second switch member and the elastic member configured to elastically press the second switch member so that the switch device returns to an original position after the switch button is pressed at the second position of the neck in which the switch button is unlocked.

13. The cleaner of claim 12, wherein the switch button is coupled to the neck in a rear side of the neck, the first switch member comprises a first coupling portion at an upper portion of the first switch member to be coupled to the second switch member; and the second switch member comprises a second coupling portion at a lower portion of the second switch member to be coupled to the first coupling portion of the first switch member, wherein the first coupling portion is disposed closer to a front side of the neck than the second coupling portion.

14. The cleaner of claim 13, wherein the switch device further comprises a shaft provided in a lower side of the first coupling portion to allow the first switch member and the second switch member to be rotatable.

15. The cleaner of claim 14, wherein the elastic member is disposed above the shaft.

16. A cleaner comprising:

a housing provided to house;

a fan motor configured to generate a suction force, and a dust collecting chamber;

a suction head having an air flow path, the suction head being couplable to the housing so that while the suction head is coupled to the housing, foreign substance from a surface to be cleaned is guided along the air flow path, using the suction force generated by the fan motor, and collected in the dust collecting chamber;

a neck, having a through hole, to allow the suction head and the housing to be connected to each other, the neck being couplable to and decouplable from the housing at a lower end of the housing; and a rotating body, couplable to the neck, so that while the rotating body is coupled to the neck, the rotating body is inside of the neck and moveable due to gravity, a switch device to be coupled to the housing and the neck, wherein the switch device comprises:

a switch button including an insertion protrusion protruding toward the neck so as to be coupled to a rear surface of the neck; and a switch member including:

a recess to receive the insertion protrusion, and a coupling protrusion protruding into the neck through the through hole of the neck, the switch member configured to be rotatable according to a pressure of the switch button so as to allow the housing and the neck to be couplable to each other and decouplable from each other, wherein while the neck is at a first position with respect to the suction head, the rotating body is in contact with the switch device to thereby lock the switch device to prevent the neck and the housing from being decoupled from each other, and while the neck is at a second position with respect to the suction head the rotating body is spaced apart from the switch device to thereby unlock the switch device to allow the neck and the housing to decouple from each other.

17. The cleaner of claim 16, wherein the neck comprises:

an outer case; and an inner case arrangeable inside of the outer case, the inner case being configured to receive the switch member between the inner case and the outer case, wherein the housing includes a fastening protrusion arrangeable at the lower end of the housing to fasten to the coupling protrusion; and the switch member includes, a first switch member to be coupled to the switch button; and a second switch member arrangeable above the first switch member so as to be coupled to the first switch member, the second switch member including the coupling protrusion protruding to into the inside of the neck to be coupled to the housing, wherein in response to the switch button being pressed, the first switch member and the second switch member are rotated to allow the coupling protrusion and the fastening protrusion to separate from each other.

18. The cleaner of claim 17, further comprising:

a rotating body rotatably coupled to the neck, and configured to lock the switch device at the first position in which the neck is inclined with respect to the suction head, and to unlock the switch device at the second position in which the neck is perpendicular to the suction head.

19. The cleaner of claim 18, wherein in response to the switch button being pressed at the first position in which the neck is inclined with respect to the suction head, the first switch member presses a lower surface of the rotating body.

20. A cleaner comprising:

a housing to house a dust collecting chamber; and a head assembly coupled to the housing and configured to suction foreign substance on a surface to be cleaned, wherein the head assembly comprises:

a suction head configured to guide the foreign substance that is suctioned from the surface to be cleaned to the dust collecting chamber;

a neck, arrangeable between the suction head and the housing, so that while the neck is arranged between the suction head and the housing, the neck connects the suction head to the housing;

a switch device configured to be pressed to separate the neck from the housing, the switch device being arranged at a rear side of the neck; and a locking member, arrangeable inside of the neck to be moveable due to gravity, wherein the locking member is configured to lock the switch device by being in contact with the switch device, so as to prevent the neck and the housing from being separated from each other while the neck is inclined with respect to the suction head.

* * * * *